US007832050B2

(12) United States Patent
Pullins et al.

(10) Patent No.: US 7,832,050 B2
(45) Date of Patent: Nov. 16, 2010

(54) FLOOR CARE APPARATUS WITH A THREE SECTION WAND ASSEMBLY

(75) Inventors: Alan T. Pullins, Richmond, KY (US); James Todd Crouch, Danville, KY (US); Michael L. Fry, Danville, KY (US); Eric J. Streciwilk, Perryville, KY (US)

(73) Assignee: Panasonic Corporation of North America, Secaucus, NJ (US)

( * ) Notice: Subject to any disclaimer, the term of this patent is extended or adjusted under 35 U.S.C. 154(b) by 902 days.

(21) Appl. No.: 11/683,477

(22) Filed: Mar. 8, 2007

(65) Prior Publication Data

US 2007/0209152 A1 Sep. 13, 2007

Related U.S. Application Data

(60) Provisional application No. 60/780,230, filed on Mar. 8, 2006.

(51) Int. Cl.
*A47L 9/32* (2006.01)

(52) U.S. Cl. ..... 15/410; 15/144.4

(58) Field of Classification Search ..... 15/410, 15/414, 143.1, 144.1, 144.3, 144.4, 344, 15/350, 361, 328, 329; 16/405, 429
See application file for complete search history.

(56) References Cited

U.S. PATENT DOCUMENTS 4,494,270 A * 1/1985 Ritzau et al. ..... 15/377
4,980,945 A 1/1991 Bewley
5,740,583 A 4/1998 Shimada et al.
5,747,764 A * 5/1998 Son et al. ..... 200/61.86
5,797,162 A * 8/1998 Vystrcil et al. ..... 15/323
5,815,883 A * 10/1998 Stein et al. ..... 15/327.1
6,148,474 A * 11/2000 Ohara et al. ..... 15/377
6,317,920 B1 11/2001 Brickner et al.
6,334,233 B1 1/2002 Roberts et al.
6,374,453 B1 4/2002 Kim
6,484,352 B2 11/2002 Huebsch et al.
6,565,123 B2 5/2003 Schiemann et al.
6,948,212 B2 * 9/2005 Oh et al. ..... 15/328
7,000,288 B2 * 2/2006 Nighy ..... 15/327.1
7,025,383 B2 4/2006 Canale
2006/0026788 A1 * 2/2006 Fischer et al. ..... 15/334
2006/0026789 A1 2/2006 Fischer et al.

FOREIGN PATENT DOCUMENTS

WO WO 02/071913 A1 9/2002

* cited by examiner

*Primary Examiner*—Dung Van Nguyen
(74) *Attorney, Agent, or Firm*—King & Schickli, PLLC

(57) ABSTRACT

A floor care apparatus includes a housing having a nozzle assembly and a canister assembly. A suction inlet is provided on the nozzle assembly. A dirt collection vessel, a suction generator and a wand receiver are carried on the housing. The cleaning wand assembly includes a telescoping subassembly, including two telescoping wand sections, and a handle subassembly including a third wand section.

20 Claims, 15 Drawing Sheets

FLOOR CARE APPARATUS WITH A THREE SECTION WAND ASSEMBLY

This application claims the benefit of U.S. Provisional Patent Application Ser. No. 60/780,230 filed on 8 Mar. 2006.

TECHNICAL FIELD

The present invention relates generally to the floor care equipment field and, more particularly, to a floor care apparatus incorporating a three section wand assembly.

BACKGROUND OF THE INVENTION

Upright vacuum cleaners and extractors have become increasingly popular over recent years. Both floor care apparatus generally incorporate a nozzle assembly that rides on wheels over the floor surface to be cleaned. A canister assembly includes an operating handle that is manipulated by an operator to move the floor care apparatus to and fro across the floor. The canister assembly also includes a dirt collector that traps dirt and debris while substantially clean air is exhausted by an electrically operated fan that is driven by an onboard motor. It is this fan and motor arrangement that generates the drop in air pressure necessary to provide the desired cleaning action.

Many upright vacuum cleaners and extractors also provide a cleaning wand that is manipulated by the hand and used to clean areas typically not reachable or generally regarded as cleanable with the suction inlet of the nozzle assembly. The present invention relates to a floor care apparatus equipped with a novel three section wand assembly.

SUMMARY OF THE INVENTION

In accordance with the purposes of the present invention as described herein, an improved floor care apparatus is provided. The floor care apparatus comprises a housing including a nozzle assembly carrying a suction inlet and a canister assembly connected to the nozzle assembly. The apparatus further includes a dirt collection vessel and a suction generator that are both carried on the housing. In addition, the floor cleaning apparatus includes a cleaning wand assembly having a telescoping subassembly and a handle subassembly.

The telescoping subassembly includes a first wand section, a second wand section telescopingly received in the first wand section, an inlet end, an outlet end and a first latch mechanism securing the first and second wand sections together. The handle subassembly includes a hand grip, and a third wand section releasably secured to the outlet end of the telescoping subassembly. A second latch mechanism secures the handle subassembly to the telescoping subassembly. The handle subassembly further includes a hose fitting connecting the third wand section to a flexible hose. The flexible hose connects the handle subassembly to the housing. An actuator switch may be carried on the handle subassembly.

A third latch mechanism secures the cleaning wand assembly to the housing. The third latch mechanism includes a latching element carried on the housing that engages a locking slot carried on the handle subassembly. The handle subassembly includes a connector housing that carries the second latch mechanism.

A cover sleeve is mounted on the connector housing so as to allow free sliding movement relative to the connector housing. The cover sleeve is displaceable between a first position covering the second latch mechanism and a second position exposing the second latch mechanism. More specifically, the connector housing includes a guide track and the cover sleeve includes a cooperating guide received in the guide track. The guide track may comprise two opposed guide channels and the guide may comprise two opposed guide ribs received in the guide channels.

The dirt collection vessel of the floor cleaning apparatus may assume a number of forms including a filter bag or dirt cup. The dirt cup may include a cylindrical dirt collection chamber, a tangentially directed inlet and an axially directed outlet so as to provide for cyclonic air flow. A primary filter may be received in the dirt cup over the axially directed outlet.

Still further, the floor cleaning apparatus may include a secondary filter provided between the dirt cup and the suction generator. In addition, a final filter may be provided downstream from the suction generator. The floor cleaning apparatus may comprise a canister vacuum cleaner, an upright vacuum cleaner or an extractor. Accordingly, the canister assembly may be pivotally connected to the nozzle assembly. In addition, the floor cleaning apparatus may include one or more rotary agitators carried on the nozzle assembly. Such an agitator functions to sweep dirt and debris into the suction inlet of the floor cleaning device from the nap of an underlying rug or carpet.

In the following description there is shown and described one possible embodiment of the invention, simply by way of illustration of one of the modes best suited to carry out the invention. As it will be realized, the invention is capable of other different embodiments, and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of this specification illustrate several aspects of the present invention, and together with the description serve to explain certain principles of the invention. In the drawings:

FIGS. 1*a* and 1*b* are respective front and rear perspective views of a floor care apparatus, in this instance an upright vacuum cleaner, constructed in accordance with the teachings of the present invention;

FIG. 4*b* is a cross sectional view illustrating the position of the valve body in the first air pathway when the cleaning wand assembly is in the first position as illustrated in FIGS. 3 and 4*a;*

FIG. 5*b* is a cross sectional view similar to FIG. 4*b* but illustrating the position of the valve body in the first air flow pathway when the cleaning wand assembly is in the second position withdrawn from the wand receiver as illustrated in FIG. 5*a;*

Reference will now be made in detail to the present invention, an example of which is illustrated in the accompanying drawings.

DETAILED DESCRIPTION OF THE INVENTION

Figure 1A:
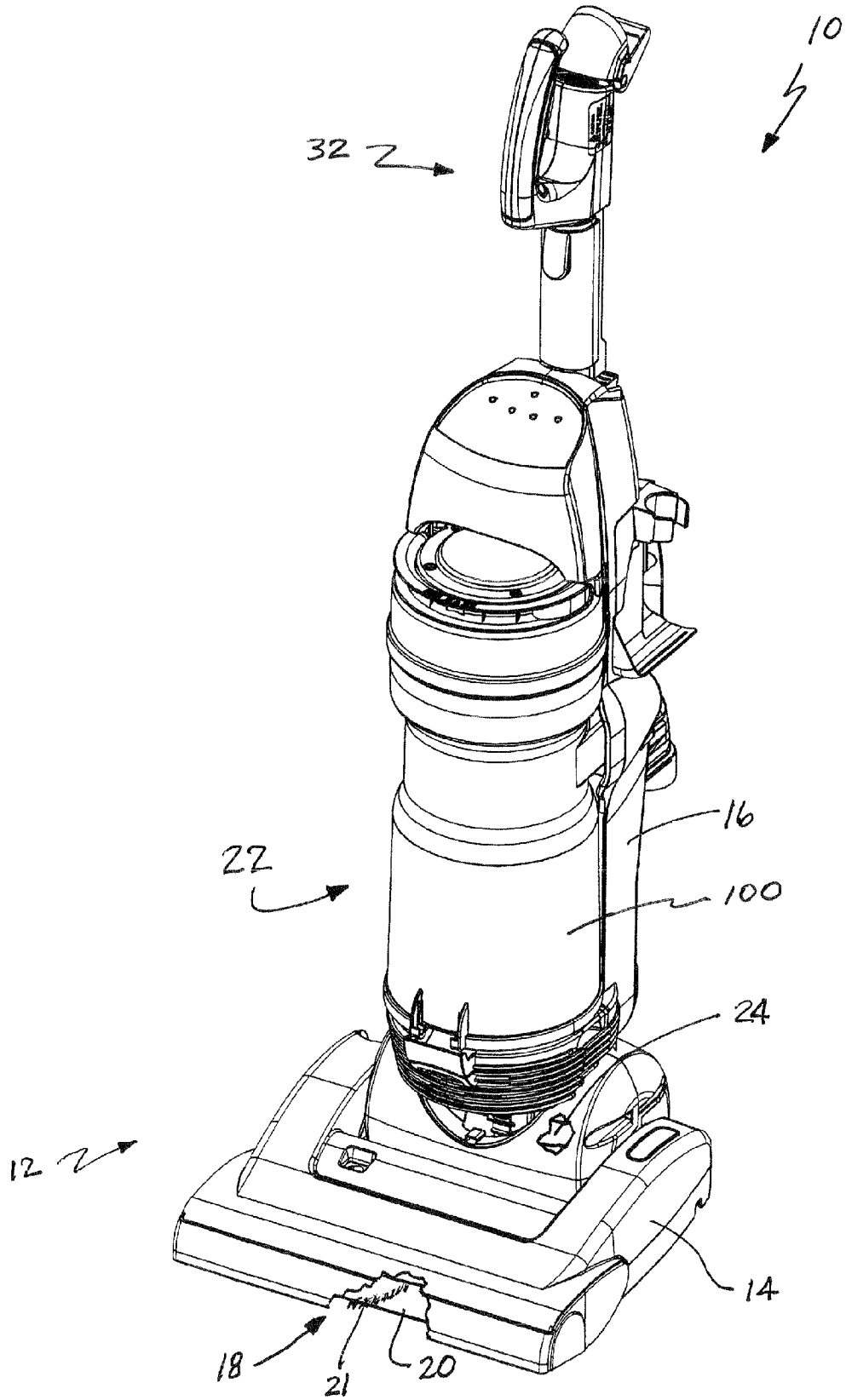
Figure 16:
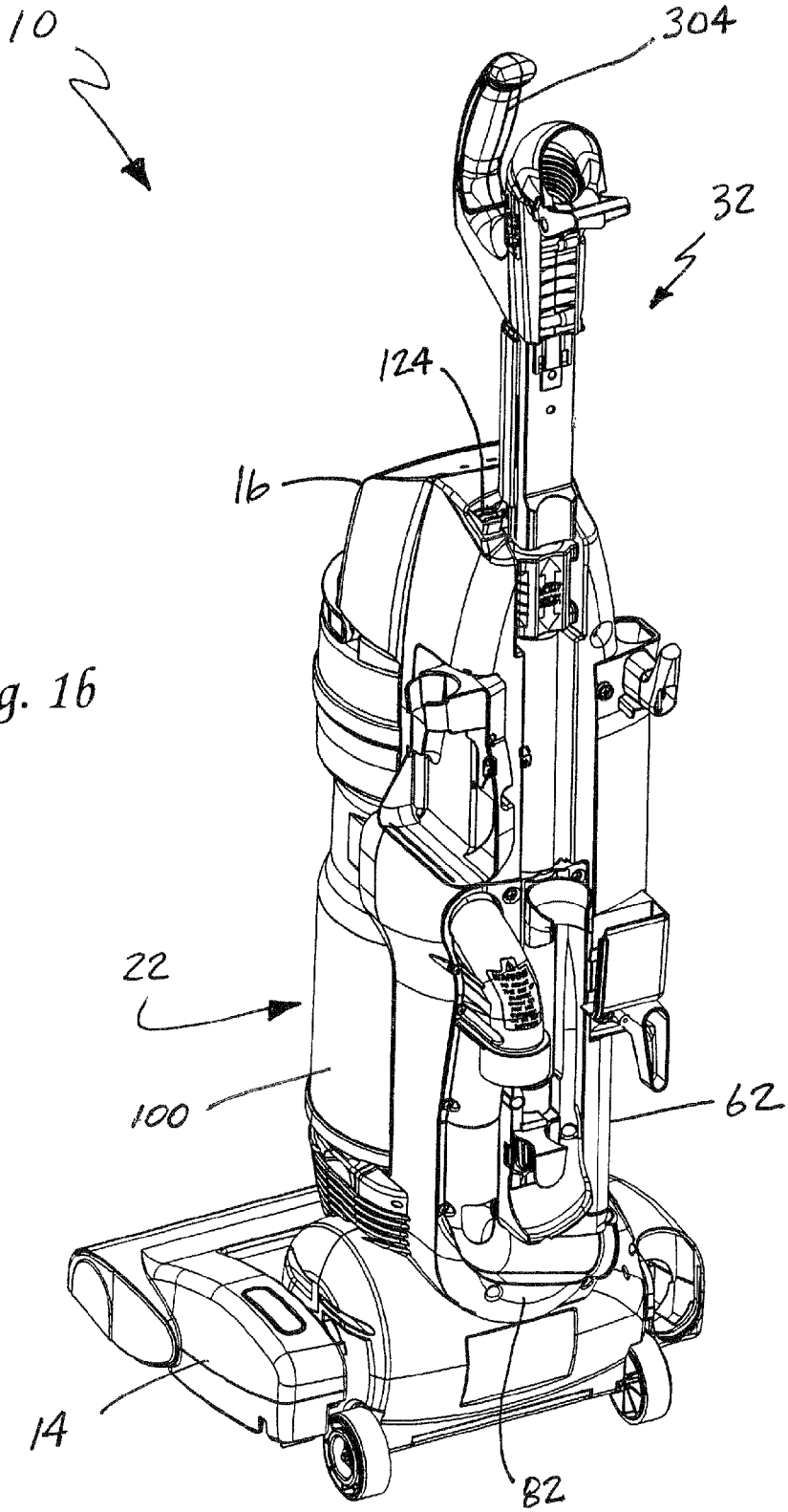

Reference is now made to FIGS. 1 and 1*a* showing a floor care apparatus 10 of the present invention. As illustrated, that apparatus 10 is an upright vacuum cleaner. It should be appreciated that while a specific upright vacuum cleaner 10 is illustrated, embodiments of the present invention also include different upright vacuum cleaners, extractors and even canister vacuum cleaners constructed in accordance with the teachings of the present invention.

The upright vacuum cleaner 10 includes a housing, generally designated by reference numeral 12, comprising a nozzle assembly 14 and a canister assembly 16. The nozzle assembly 14 includes a suction inlet 18. The nozzle assembly may also carry a rotary agitator 20 adjacent the suction inlet 18. The rotary agitator 20 includes cleaning elements 21 such as brushes, bristle tufts, beater bars or the like. As the rotary agitator 20 rotates, the cleaning elements 21 engage the nap of an underlying rug or carpet and serve to sweep dirt and debris into the suction inlet 18 in a manner well known in the art, The canister assembly 16 carries a dirt collection vessel, generally designated by reference numeral 22, and a suction generator 24.

Figure 6:
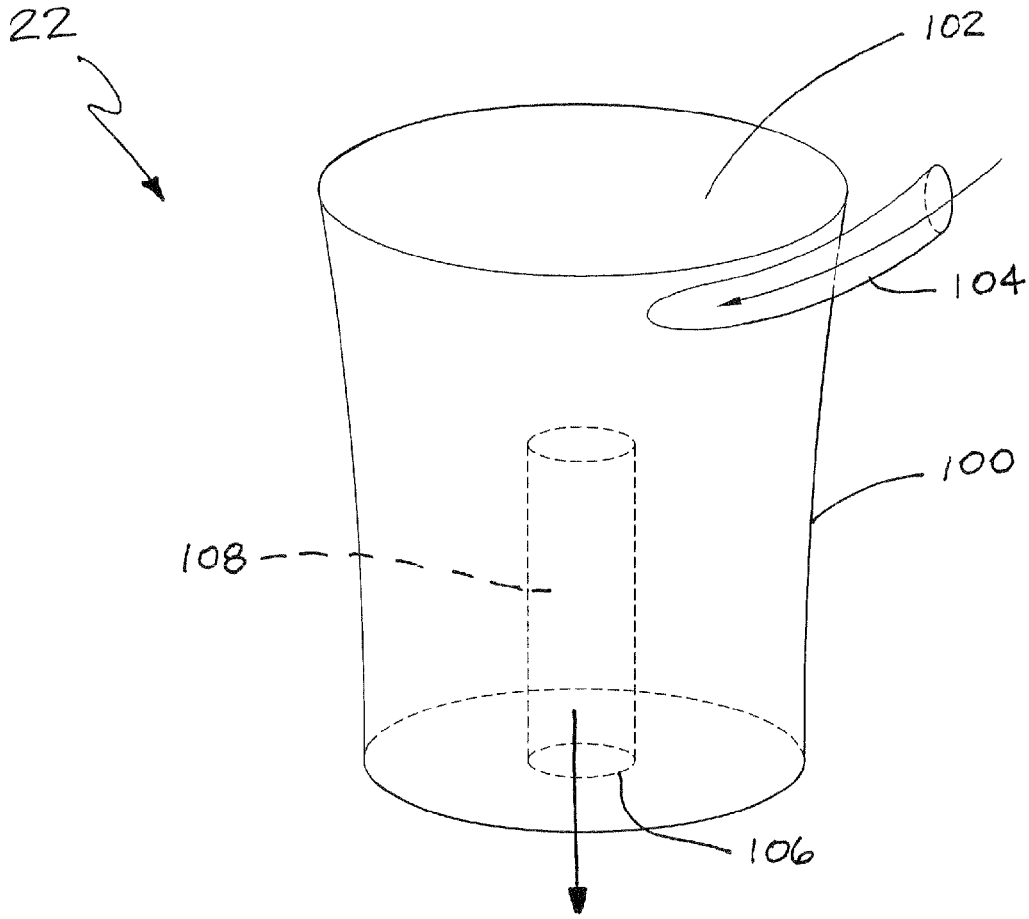
FIG. 6 is a schematical representation of a dirt cup providing for cyclonic airflow.

The dirt collection vessel 22 may take the form of a filter bag such as a standard vacuum cleaner bag, which traps dirt and debris but includes pores to allow the passage of air through the bag. Alternatively, the dirt collection vessel 22 may take the form of a dirt cup 100 as illustrated in FIGS. 1 and 6. That dirt cup 100 may include a cylindrical dirt collection chamber 102, a tangentially directed inlet 104 and an axially directed outlet 106 in order to provide for cyclonic air flow and the cleaning benefits associated with that air flow that are well known in the art. If desired, a primary filter 108 may be provided in that dirt cup 100 over the axially directed outlet 106.

Figure 7:
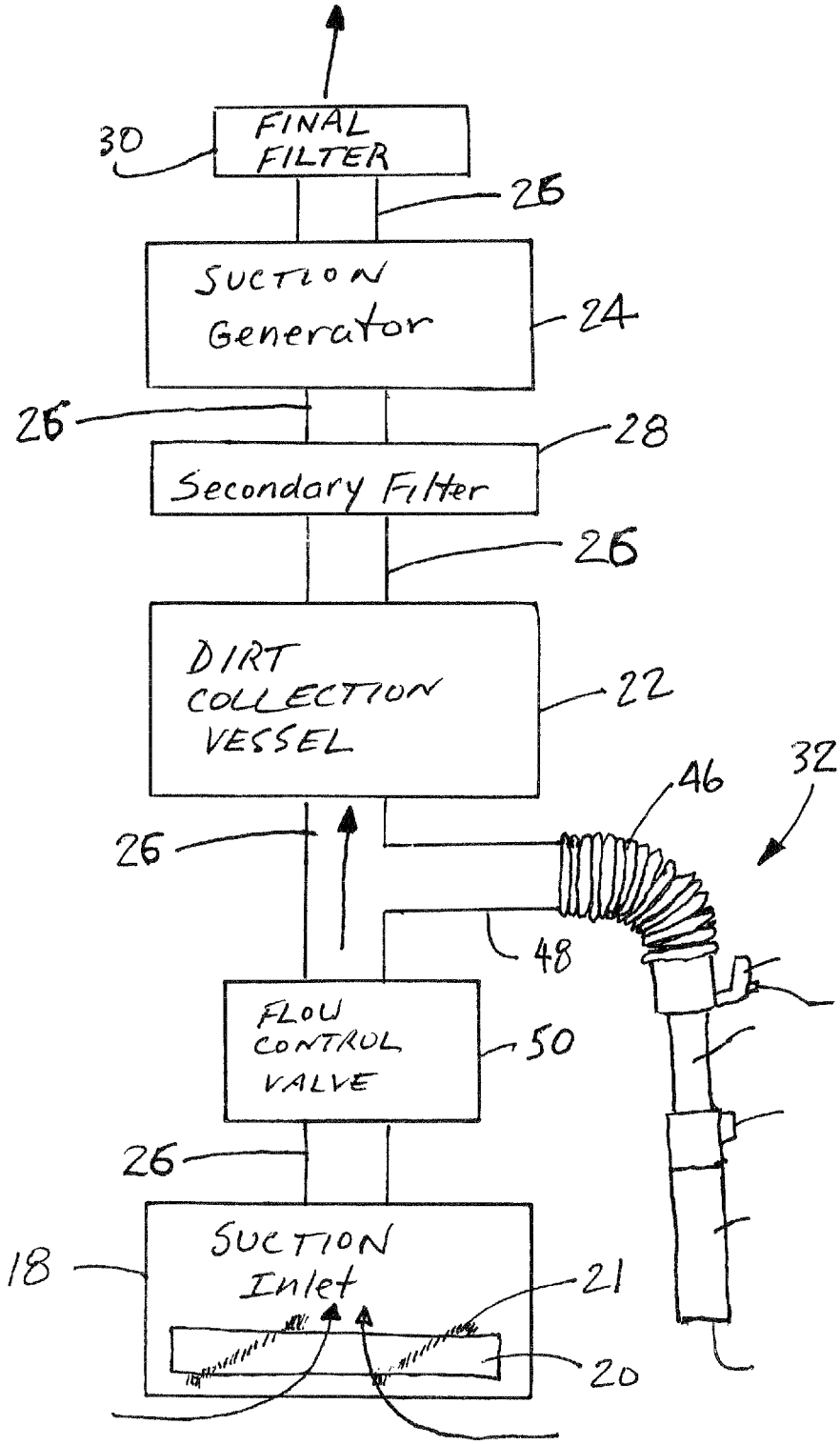
FIG. 7 is a schematical air flow diagram for the vacuum cleaner of the present invention.
Figure 8:
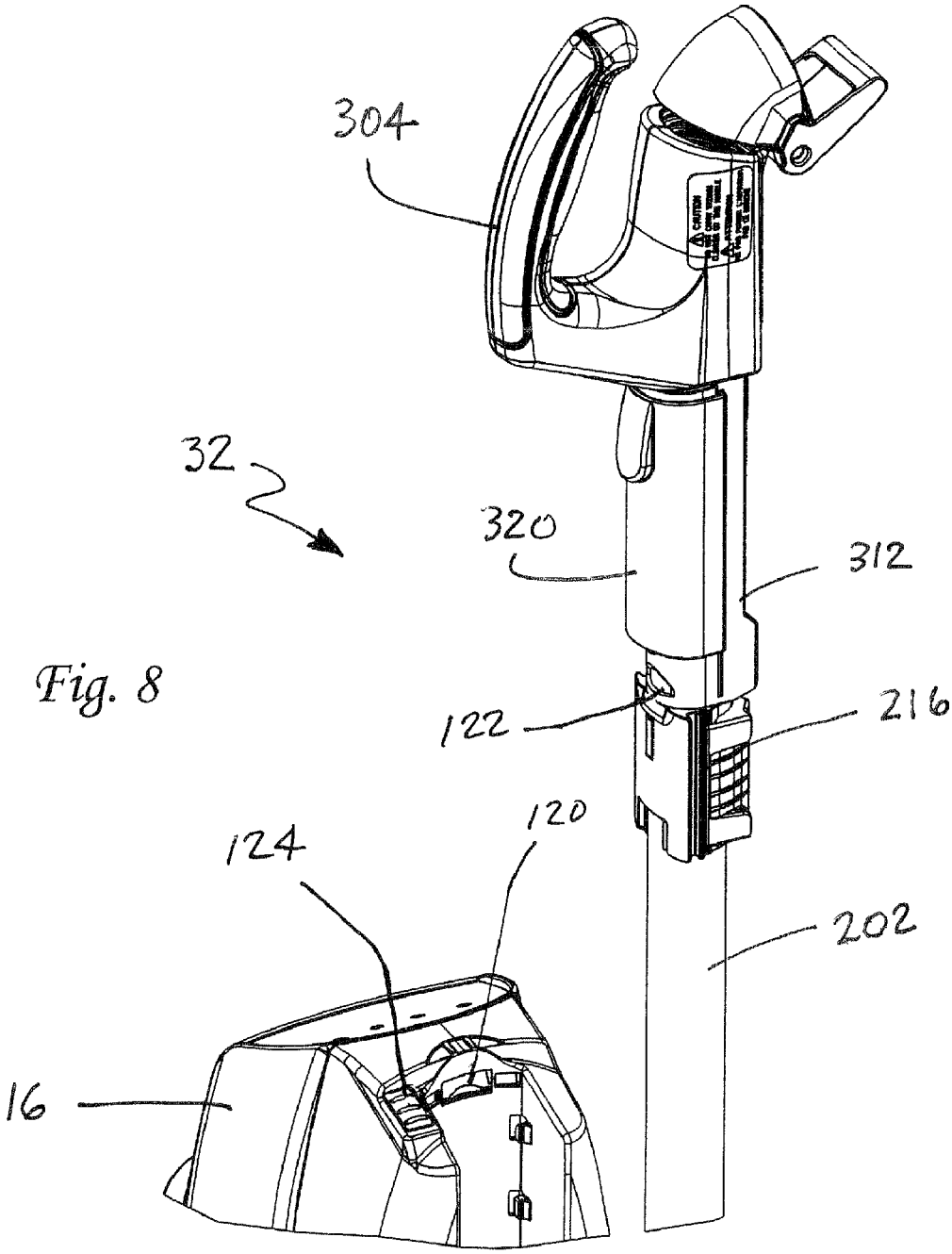
FIG. 8 is a partially exploded, perspective view illustrating the latch mechanism for holding the cleaning wand assembly in the fully seated position on the canister assembly.

As best illustrated in FIG. 7, a first air flow pathway 26 connects and provides fluid communication between the suction inlet 18, the dirt collection vessel 22 and the suction generator 24. A secondary filter 28 may be provided in the first air flow pathway 26 between the dirt collection vessel 22 and the suction generator 24. In addition, a final filter 30, such as a HEPA filter, may be provided in the first air flow pathway 26 downstream from the suction generator 24. The final filter 30 cleans any remaining dirt and debris from the air stream passing through the vacuum cleaner 10 before that air stream is returned to the environment. This includes any carbon particles that might have been picked up in the air stream after it passes over the motor of the suction generator 24 in order to provide cooling.

Figure 2:
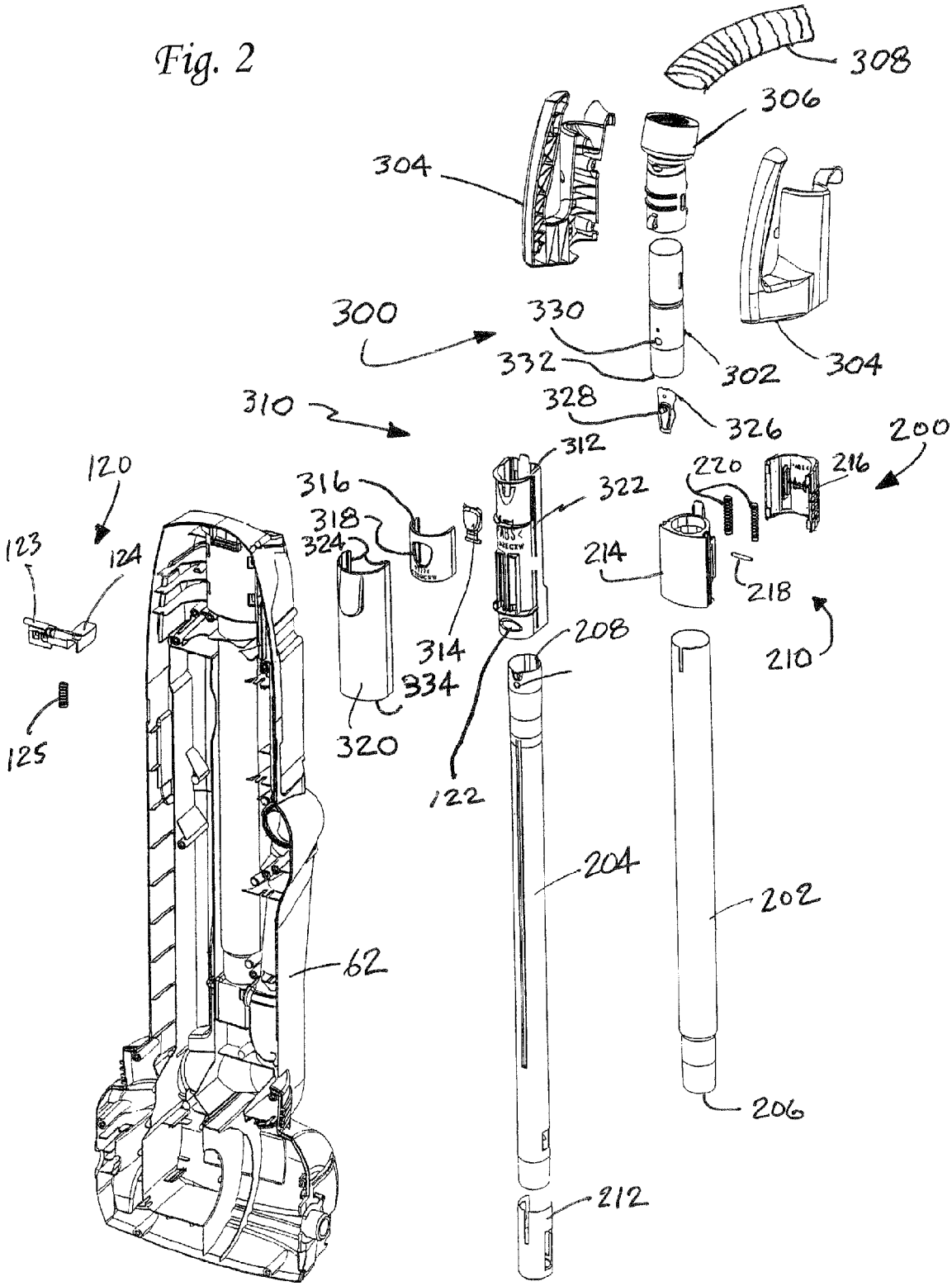
FIG. 2 is an exploded perspective view illustrating the cleaning wand assembly, the rear shell of the canister assembly and the latch mechanism that secures the wand assembly to the canister assembly.

A cleaning wand assembly, generally designated by reference numeral 32 is carried on the housing 12 of the vacuum cleaner. As best illustrated in FIG. 2, the cleaning wand assembly 32 includes a telescoping subassembly generally designated by reference numeral 200 and a handle subassembly generally designated by reference numeral 300. The telescoping subassembly 200 includes a first wand section 202, a second wand section 204, an inlet 206, an outlet 208 and a first latch mechanism 210. More specifically, the second wand section 204 is telescopingly received in the first wand section 202. A coupler 212 connected to the end of the wand section 204 is made from a low friction material in order to allow free telescoping movement while also substantially sealing between the two wand sections 202, 204. The inlet 206 is provided at a first end of the wand section 202 while the first latch mechanism 210 is carried on the first wand section adjacent the opposite or second end.

The first latch mechanism 210 includes a housing 214, a slide knob actuator 216 and a hardened latch pin 218. A pair of springs 220 bias the slide knob actuator 216 into the first or locked position where a cam 222 carried on the actuator 216 presses the latch pin 218 into one of a series of grooves 224 spaced along the length of the first wand section 202. In this position the latch mechanism 210 functions to secure the first and second wand sections 202, 204 together (see also FIG. 3).

The operator may adjust the length of the telescoping subassembly 200 by sliding the knob actuator 216 to a second position wherein the latch pin 218 is received within the slot (not shown) on the knob actuator and thereby free of any of the locking grooves 224 provided on the first wand section 202. The first wand section 202 may then be extended from the second wand section 204 to lengthen the telescoping subassembly 200 or retracted into the second wand section to shorten the telescoping subassembly. Once the operator has adjusted the telescoping subassembly 200 to a desired length, the operator releases the slide knob actuator 216. The biasing springs 220 then return the slide knob actuator 216 to the first or locking position and the cam 222 forces the latch pin 218 into the aligned locking groove 224 on the first wand section 202 thereby again securing the wand sections 202, 204 together and locking the telescoping subassembly 200 at a selected length.

The handle subassembly 300 includes a third wand section 302, a hand grip 304 formed from two cooperating sections and a hose fitting 306. The hose fitting 306 is attached to one end of a flexible hose 308 that connects the cleaning wand assembly 32 to the canister assembly 16 of the vacuum cleaner 10.

A second latch mechanism, generally designated by reference numeral 310 functions to lock the handle subassembly 300 together with the telescoping subassembly 200. More specifically, the second latch mechanism 310 includes a connector housing 312 that is secured to the end of the first wand section 202 so as to encompass the outlet 208 of the second wand section 204. An actuator button 314 is carried on the connector housing 312. More specifically, the actuator button 314 is pivotally mounted to the connector housing 312 and captured by the snap-on holder 316. The holder 316 includes an aperture 318. The actuator button 314 has a raised portion that projects through the aperture 318 so as to provide free access to the button. A cover sleeve 320 is carried on the connector housing 312 in a manner that allows free sliding movement of the cover sleeve 320 relative to the connector housing 312. In the illustrated embodiment the connector housing 312 includes a guide track in the form of two opposed guide channels 322 and a guide in the form of two opposed guide ribs 324 that are received in the guide channels.

Figure 9A:
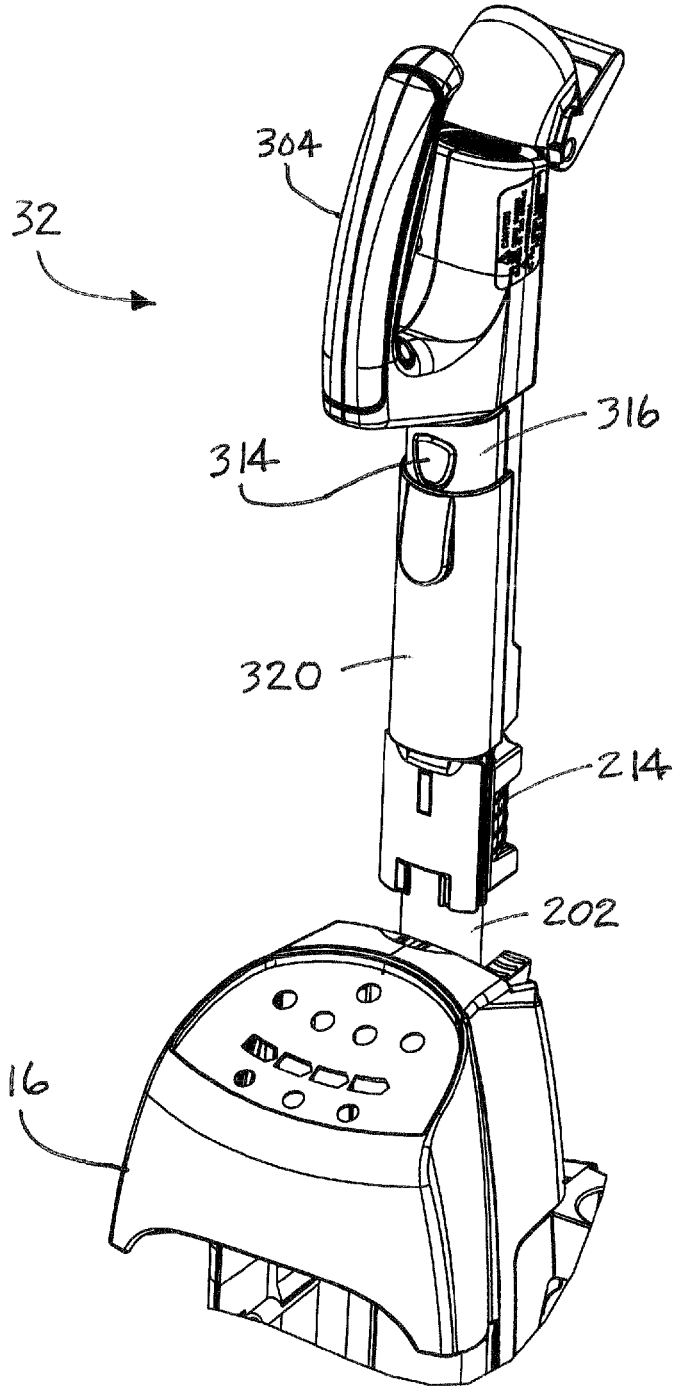
FIGS. 9*a* and 9*b* are detailed perspective views illustrating, respectively, the sleeve of the handle assembly in the first position covering the second latch mechanism and the second position exposing the second latch mechanism.
Figure 9B:
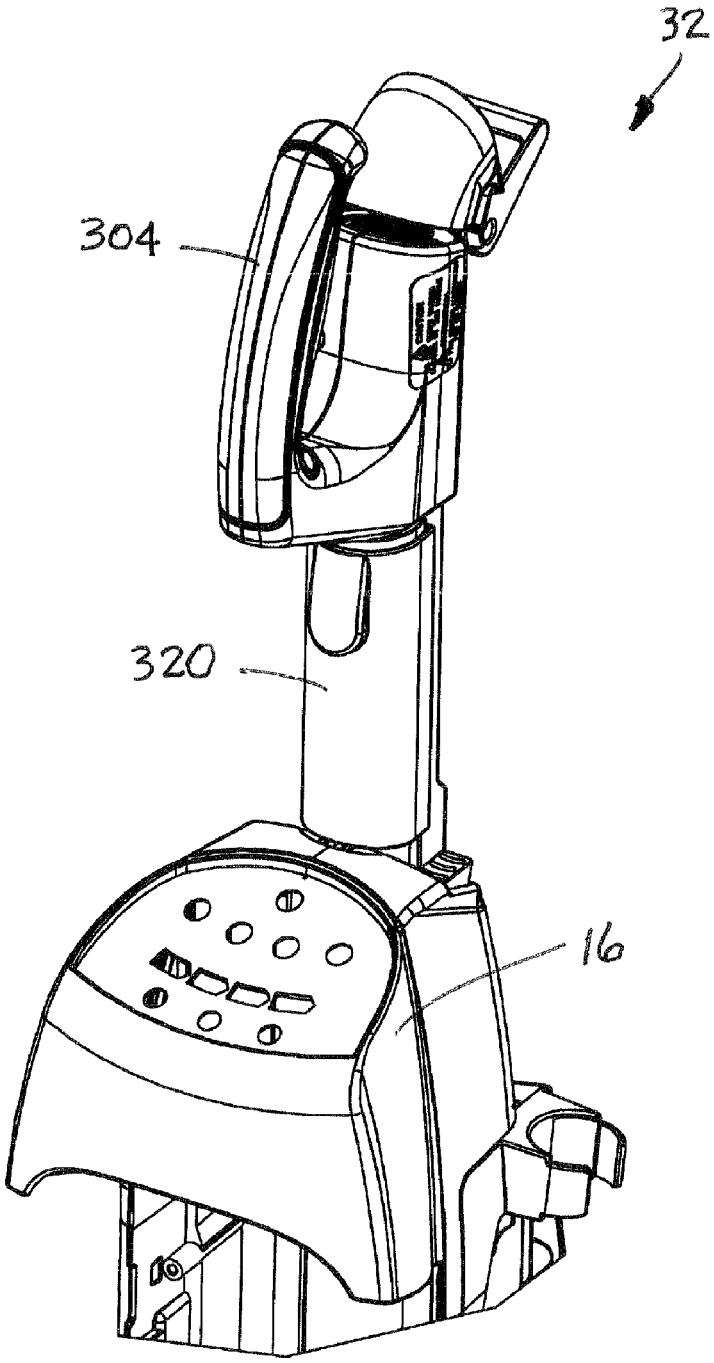

The cover sleeve 320 is displaceable between a first position covering the actuator button 314 of the second latch mechanism 310 (see FIG. 9*a*) and a second position exposing the actuator button (see FIG. 9*b*).

The second latch mechanism 310 includes a spring loaded, locking detent 326 that is carried by the third wand section 302. The spring loaded detent 326 includes a projecting lug 328 that extends through an aperture 330 in the third wand section 302.

The handle subassembly 300 is connected to the telescoping subassembly 200 by inserting the distal end 332 of the third wand section 302 into the outlet 208 of the first wand section 202 of the telescoping subassembly. When properly seated the lug 328 of the spring loaded detent 326 engages in the aligned locking aperture 228 on the first wand section 202 thereby securing the telescoping subassembly 200 and handle subassembly 300 together.

The entire cleaning wand assembly 32 including both the telescoping subassembly 200 and handle subassembly 300 may then be mounted on the canister assembly 16. This is done by inserting the distal end of the wand assembly 32 into the wand receiver 60 formed in the rear housing 62 of the canister assembly 16.

Figure 10:
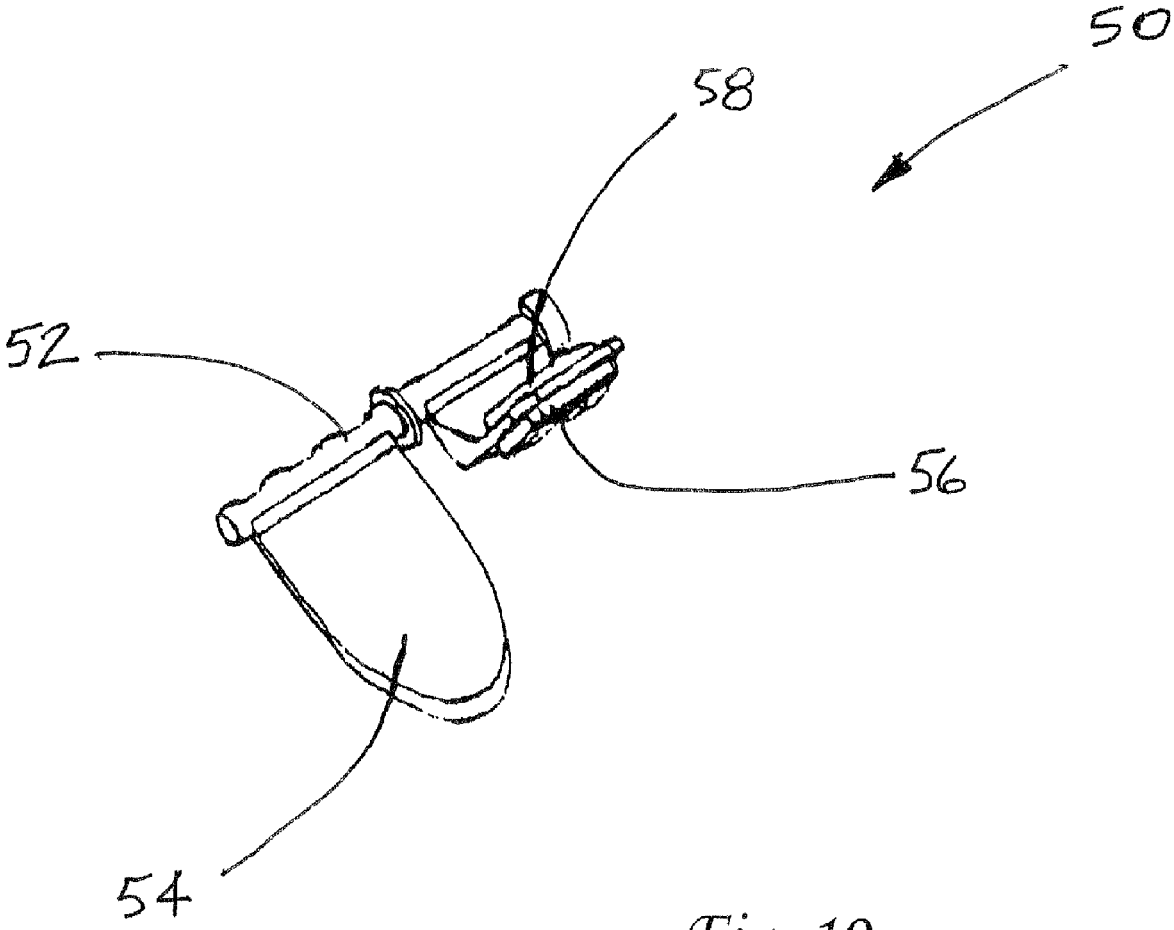
FIG. 10 is a detailed perspective view of the flow control valve.

When the wand assembly 32 is fully seated in the wand receiver 60, the distal end of the wand assembly engages a flow control valve 50. More specifically, as best illustrated in FIG. 10, the flow control valve 50 includes a pivot shaft 52 that carries a valve body 54 and an actuator 56. The actuator 56 carries a sealing ring 58 that is sized and shaped to plug the inlet 206 of the cleaning wand assembly 32 (see FIG. 4*a*) when the cleaning wand assembly 32 is received in the wand receiver 60 carried on the housing 12 and fully seated on the actuator 56 of the flow control valve 50.

Figure 11:
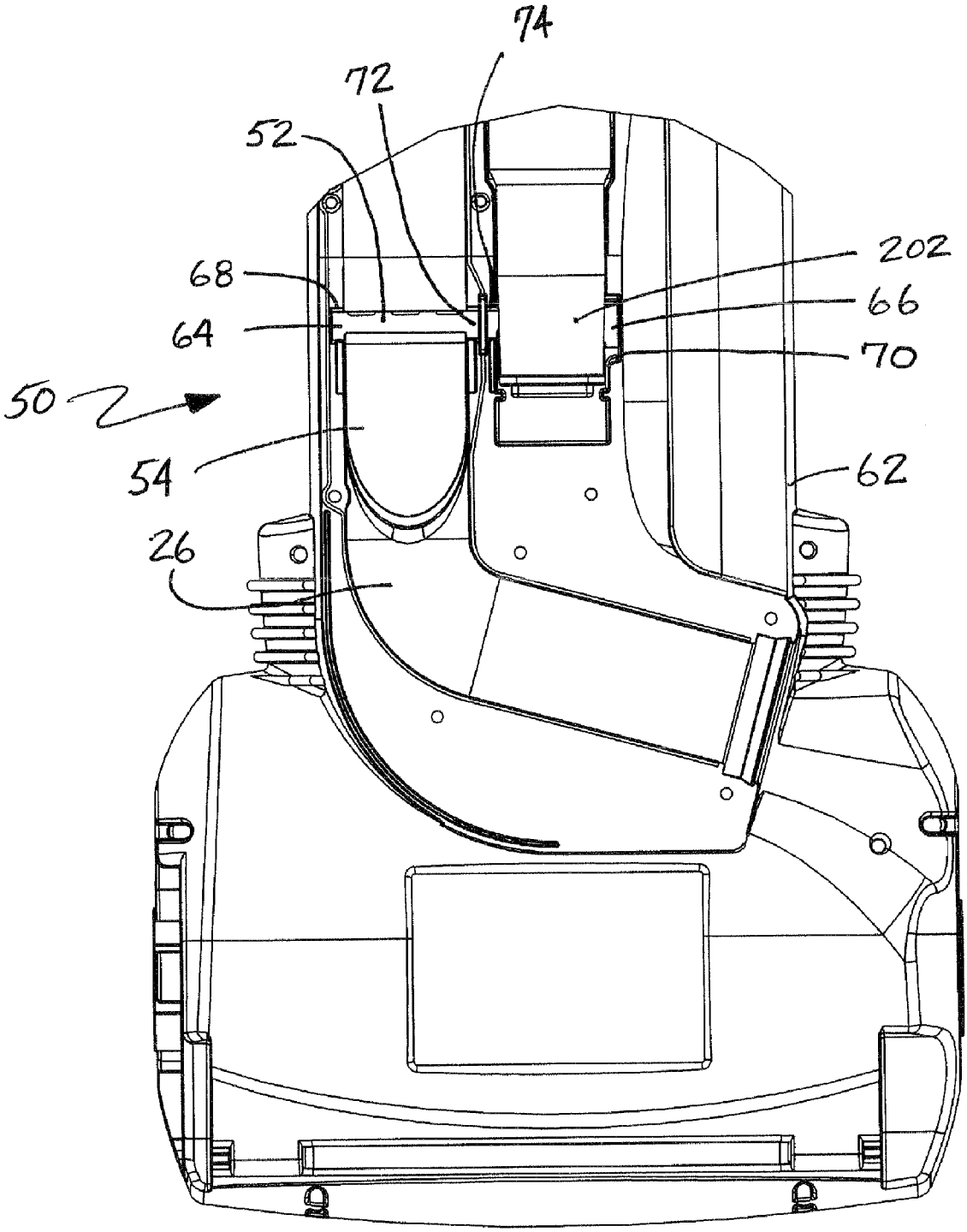
FIG. 11 is a detailed rear elevational view illustrating how the flow control valve and casing spring are mounted in the canister assembly.

As best illustrated in FIG. 11, the flow control valve 50 is mounted for pivoting movement with respect to the rear shell 62 of the canister assembly 16. More specifically, the first and second ends 64, 66 of the pivot shaft 52 are received in cooperating grooves 68, 70 provided on the rear shell 62 while an intermediate section 72 of the pivot shaft between the valve body 54 and actuator 56 is received in the slot 74 provided on the rear shell 62.

The flow control valve 50 is biased into a normally closed position by means of a leaf-spring 76 having a first end received in a notch or groove 78 on the underside of the actuator 56 opposite the sealing ring 58. The opposite end of the leaf-spring 76 engages the bottom wall 80 of the wand receiver 60 formed in the rear shell 62. A cover 82 may be secured to the rear shell 62 by fasteners such as screws (not shown). A keeper lug (not shown) provided on the cover 82 includes a channel that receives the pivot shaft 72 and functions to hold the pivot shaft 72 in place in the slot 74. The cover 82 may be removed to provide access to the flow control valve 50, the first air flow pathway 26 and the wand receiver 60 for service if needed.

Figure 3:
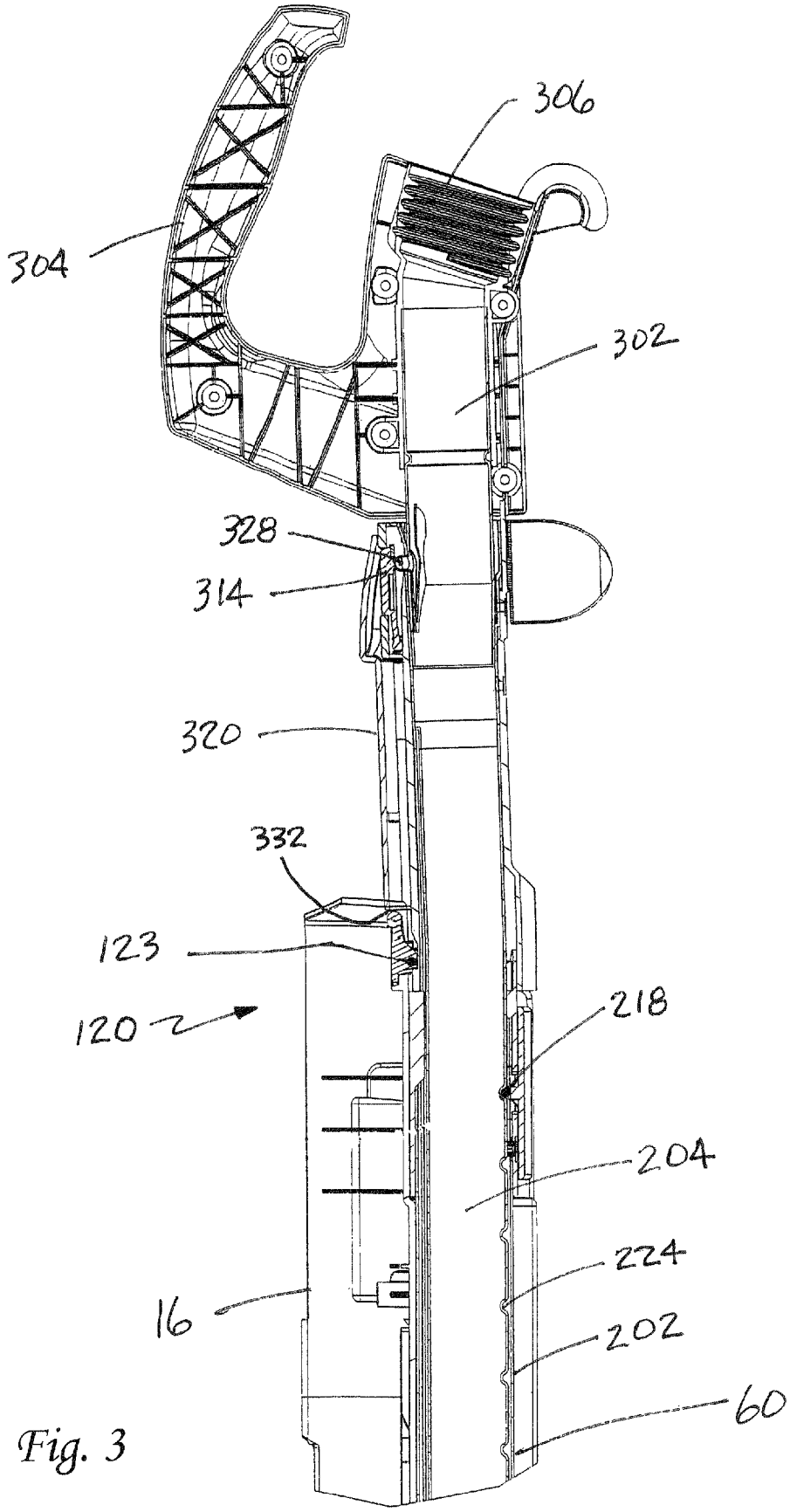
FIG. 3 is a detailed cross-sectional view illustrating the cleaning wand assembly fully seated and locked into the wand receiver on the canister assembly.
Figure 4A:
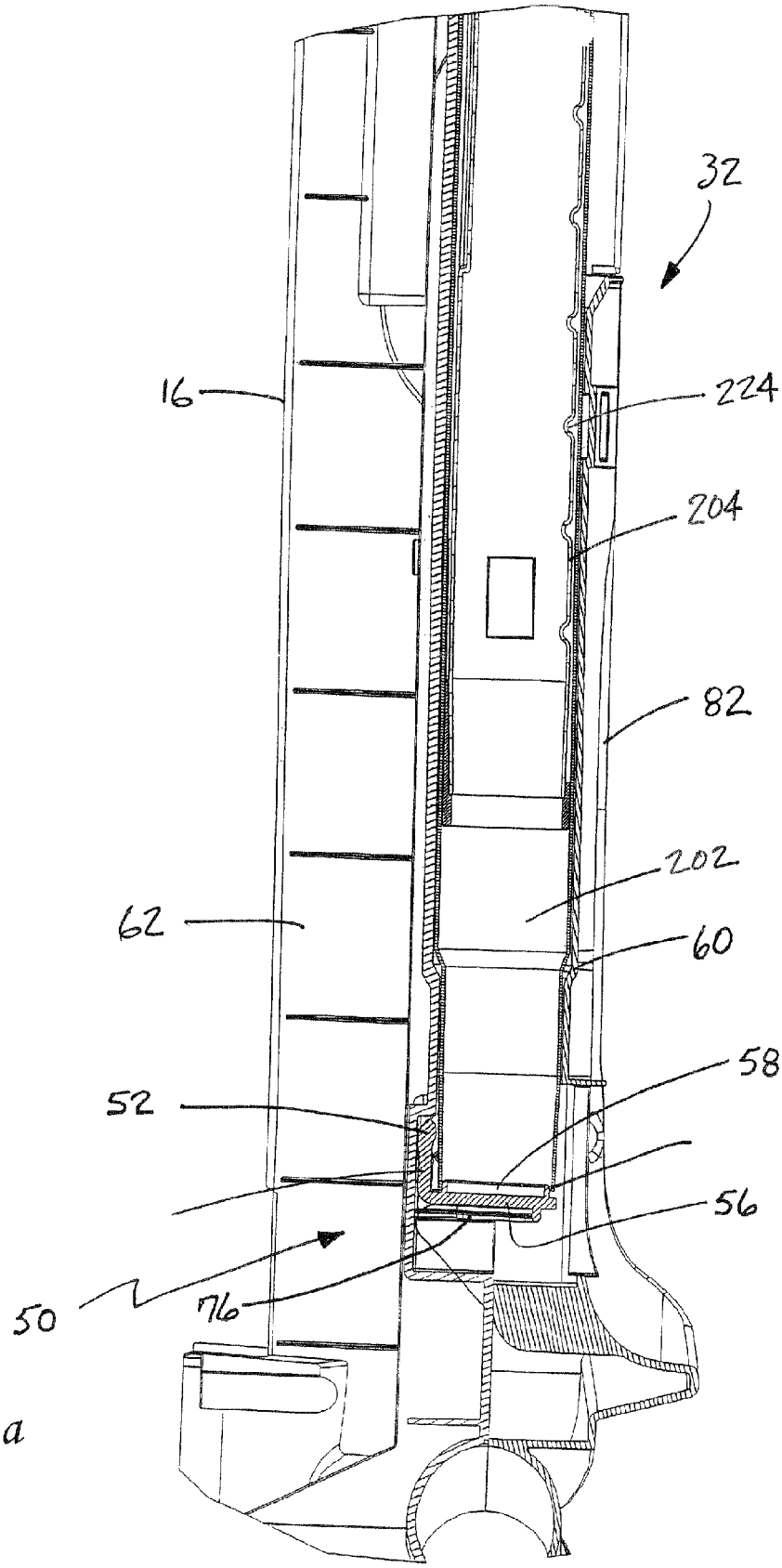
FIG. 4*a* is a detailed cross sectional view illustrating the cleaning wand assembly received in the wand receiver and fully seated on the actuator.
Figure 46:
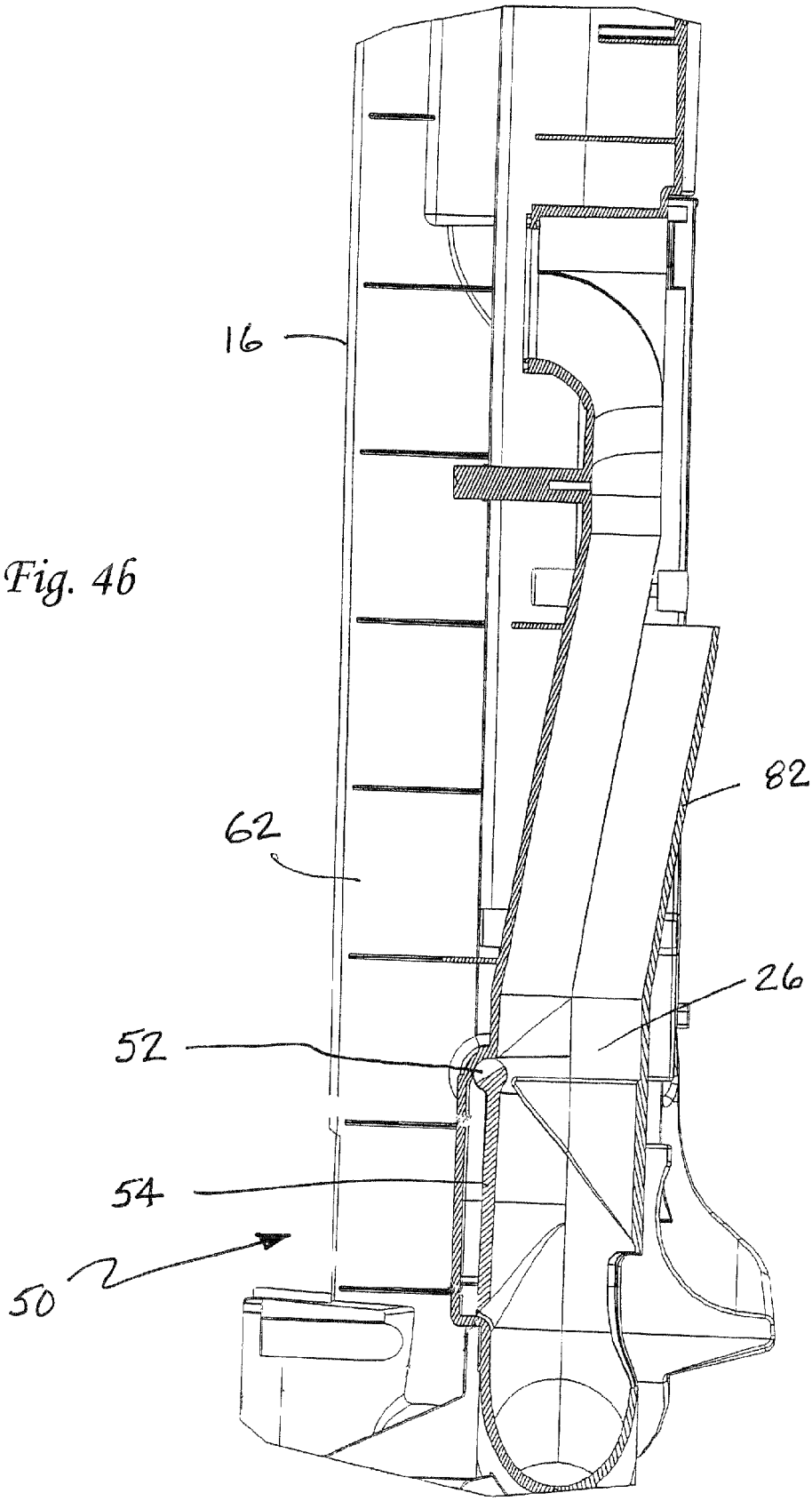

During normal upright vacuum cleaner operation, the cleaning wand assembly 32 is received in the wand receiver 60 on the rear of the canister assembly 16 (see FIGS. 3, 4*a* and 4*b*). The cleaning wand assembly 32 is secured in the first position by means of a third latch mechanism 120 carried on the canister housing 16. The latch mechanism 120 includes a combined actuator 124 and latch element 123. When the wand assembly 32 is fully seated in the wand receiver 60, the latch element 123 is biased by a spring 125 into engagement with the latching slot 122 on the connector housing 312 of the wand assembly 32 thereby securing the wand assembly. When one wishes to remove the wand assembly 32 from the canister housing 16 for specialty cleaning, one depresses the actuator 124. This action releases the latch element 123 from the slot 122 thereby freeing the wand assembly 32 for removal or withdrawal from the wand receiver 60.

As the wand assembly 32 is inserted into the wand receiver 60 and fully seated therein, the leading edge 334 of the cover sleeve 320 engages the latch mechanism 120. This insures that the cover sleeve 320 is moved into the first position where the sleeve covers the actuator button 314 of the second latch mechanism 310. Since the actuator button 314 is covered, the operator cannot inadvertently engage the button and release the handle subassembly 300 from the telescoping subassembly 200 and the canister assembly 16. Thus, the operator is in full control of the vacuum cleaner 10 at all times.

When the cleaning wand assembly 32 is fully seated in the wand receiver 60 and secured to the canister assembly 16 by the latch mechanism 120, the valve body 54 is pivoted in the first airflow pathway 26 so that the first air flow pathway is fully open (see FIG. 4*b*). Thus, when the cleaning wand assembly 32 is in this position, the hand grip 204 of the cleaning wand assembly 32 may be used to manipulate the vacuum cleaner 10 back and forth across the floor. Dirt and debris drawn into the suction inlet 18 flows freely through the first air flow pathway 26 past the flow control valve 50 into the dirt collection vessel 22. Dirt and debris are collected in the dirt collection vessel 22 before the air stream is then drawn through the suction generator 24 and returned to the environment.

Figure 5A:
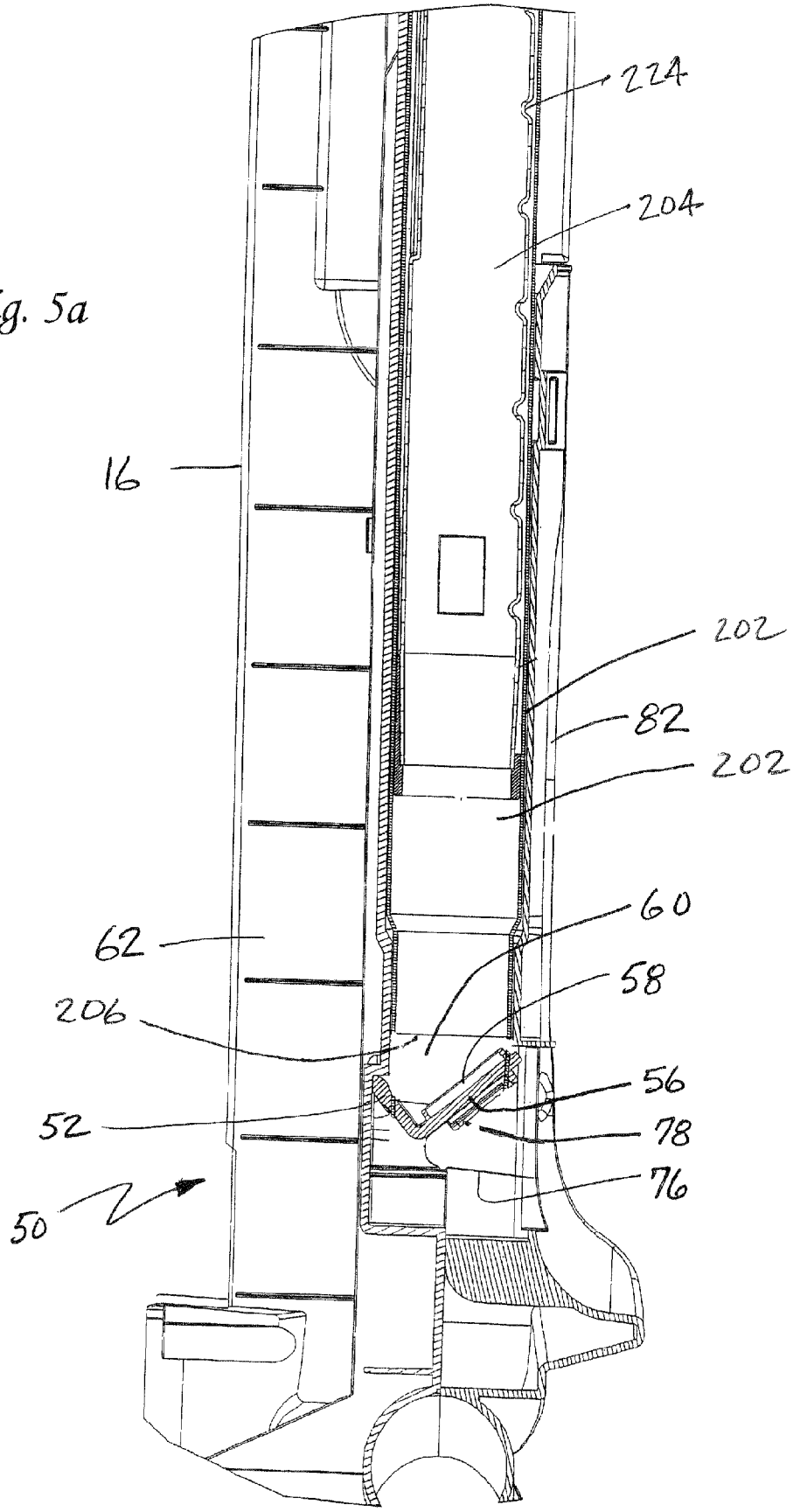
FIG. 5*a* is a cross sectional view similar to FIG. 4*a* but illustrating the wand cleaning assembly withdrawn from the fully seated position in the wand receiver.
Figure 56:
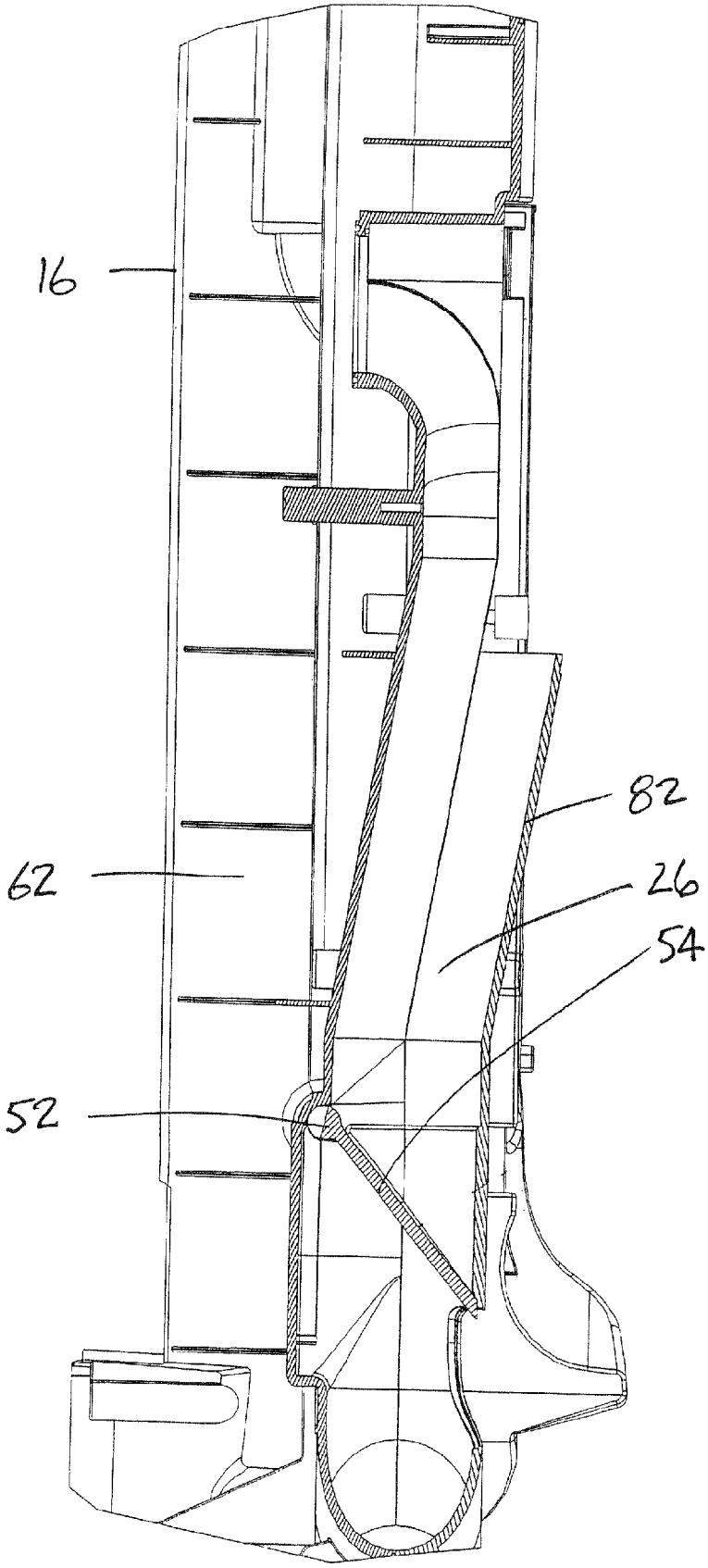

When the operator desires to perform a specialty cleaning function using the cleaning wand assembly 32, the operator depresses the actuator 124 to release the latch element 123 from the latching slot 122 as described above. The cleaning wand assembly 32 is then withdrawn from the wand receiver 60. As the cleaning wand assembly 32 is being withdrawn, the inlet 206 thereof becomes unseated from the actuator 56. The leaf-spring 76 then functions to bias the flow control valve 50 to its normally closed position (see FIGS. 5*a* and 5*b*). When this occurs, the valve body 54 extends across and fully closes the first air flow pathway 26 leading to the suction inlet 18.

When the inlet 206 of the cleaning wand assembly 32 is removed from the sealing ring 58 of the actuator 56, air is drawn by the suction generator 24 through the cleaning wand assembly 32, the hose 46, the second air flow pathway 48, and the first air flow pathway 26 upstream of the valve body 54 into the dirt collection vessel 22. Thus, dirt and debris drawn into the vacuum cleaner 10 through the cleaning wand assembly 32 is trapped in the dirt collection vessel 22 before the air stream is drawn through the suction generator 24 and returned to the environment (see also FIG. 7).

If desired, the operator may also release the handle subassembly 300 from the telescoping subassembly 200. More specifically, the cover sleeve 320 is moved from the first position (see FIG. 9*a*) to the second position (see FIG. 9*b*) to expose the actuator button 314. The button 314 is then depressed to force the lug 328 of the spring loaded detent 326 from the locking aperture 228 on the second wand section 204. The handle subassembly 200 is then removed from the telescoping subassembly 200. Cleaning may then be performed by drawing dirt and debris into the open end 332 of the third wand section 302.

The foregoing description of the preferred embodiment of this invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

What is claimed is:

1. A floor cleaning apparatus, comprising:

a housing including a nozzle assembly with a suction inlet and a canister assembly;

a suction generator carried on said housing;

a dirt collection vessel carried on said housing; and a cleaning wand assembly including a telescoping subassembly and a handle subassembly;

said telescoping subassembly including a first wand section, a second wand section telescopingly received in said first wand section, an inlet end, an outlet end and a first latch mechanism securing said first and second wand section together; and said handle subassembly including a hand grip and a third wand section releasably secured to said outlet end of said telescoping subassembly;

a second latch mechanism securing said handle subassembly to said telescoping subassembly; and a third latch mechanism securing said cleaning wand assembly to said housing, said third latch mechanism including a latching element carried on said housing that engages a locking slot carried on said handle subassembly.

2. The floor cleaning apparatus of claim 1 further including a flexible hose connecting said handle subassembly to said housing.

3. The floor cleaning apparatus of claim 2, wherein said handle subassembly includes a hose fitting connecting said third wand section to said flexible hose.

4. The floor cleaning apparatus of claim 3, further including an actuator switch carried on said handle subassembly.

5. The floor cleaning apparatus of claim 1, wherein said handle subassembly includes a connector housing that carries said second latch mechanism.

6. The floor cleaning apparatus of claim 5, further including a cover sleeve mounted on said connector housing so as to allow free sliding movement relative to said connector housing, said cover sleeve being displaceable between a first position covering said second latch mechanism and a second position exposing said second latch mechanism.

7. The floor cleaning apparatus of claim 6, wherein said connector housing includes a guide track and said cover sleeve includes a cooperating guide received in said guide track.

8. The floor cleaning apparatus of claim 7, wherein said guide track comprises two opposed guide channels and said guide comprises two opposed guide ribs received in said guide channels.

9. The floor cleaning apparatus of claim 8, wherein said second latch mechanism includes a spring loaded detent carried on said third wand section and an actuator button carried on said connector housing.

10. The floor cleaning apparatus of claim 1, wherein said dirt collection vessel is a filter bag.

11. The floor cleaning apparatus of claim 1, wherein said dirt collection vessel is a dirt cup.

12. The floor cleaning apparatus of claim 11, wherein said dirt cup includes a cylindrical dirt collection chamber, a tangentially directed inlet and an axially directed outlet.

13. The floor cleaning apparatus of claim 12, further including a primary filter received in said dirt cup.

14. The floor cleaning apparatus of claim 13, further including a secondary filter provided between said dirt cup and said suction generator.

15. The floor cleaning apparatus of claim 14, further including a final filter downstream from said suction generator.

16. The floor cleaning apparatus of claim 1, wherein said canister assembly is pivotally connected to said nozzle assembly.

17. The floor cleaning apparatus of claim 1, further including at least one rotary agitator carried on said nozzle assembly.

18. A floor cleaning apparatus, comprising:

a housing including a nozzle assembly with a suction inlet and a canister assembly;

a suction generator carried on said housing;

a dirt collection vessel carried on said housing; and a cleaning wand assembly including a telescoping subassembly and a handle subassembly;

said telescoping subassembly including a first wand section, a second wand section telescopingly received in said first wand section, an inlet end, an outlet end and a first latch mechanism securing said first and second wand section together; and said handle subassembly including a hand grip and a third wand section releasably secured to said outlet end of said telescoping subassembly; and a second latch mechanism securing said handle subassembly to said telescoping subassembly;

wherein said handle subassembly includes a connector housing that carries said second latch mechanism and said apparatus further includes a cover sleeve mounted on said connector housing so as to allow free sliding movement relative to said connector housing, said cover sleeve being displaceable between a first position covering said second latch mechanism and a second position exposing said second latch mechanism.

19. The floor cleaning apparatus of claim 18, wherein said connector housing includes a guide track and said cover sleeve includes a cooperating guide received in said guide track.

20. The floor cleaning apparatus of claim 18, wherein said second latch mechanism includes a spring loaded detent carried on said third wand section and an actuator button carried on said connector housing.

* * * * *